United States Patent [19]

Katterfeldt et al.

[11] 4,161,625

[45] Jul. 17, 1979

[54] METHOD FOR DETERMINING THE FUNDAMENTAL FREQUENCY OF A VOICE SIGNAL

[75] Inventors: Harald Katterfeldt, Ulm; Helmut Mangold, Aufheim, both of Fed. Rep. of Germany

[73] Assignee: Licentia, Patent-Verwaltungs-G.m.b.H., Frankfurt, Fed. Rep. of Germany

[21] Appl. No.: 891,144

[22] Filed: Mar. 28, 1978

[30] Foreign Application Priority Data

Apr. 6, 1977 [DE] Fed. Rep. of Germany ..... 2715411

[51] Int. Cl.[2] ..... G10L 1/02

[52] U.S. Cl. ..... 179/1 SC

[58] Field of Search ..... 179/1 SC, 1 SA

[56] References Cited

U.S. PATENT DOCUMENTS 4,015,088 3/1977 Dubnowski et al. ..... 179/1 SC

OTHER PUBLICATIONS

M. Sondhi, "New Methods of Pitch Extraction", IEEE Trans. Audio and EA, Jun. 1968, pp. 262–266.

J. Markel, "The SIFT Algorithm", IEEE Trans. on Audio and EA, Dec. 1972, pp. 367–377.

*Primary Examiner*—Kathleen H. Claffy

*Assistant Examiner*—E. S. Kemeny

*Attorney, Agent, or Firm*—Spencer & Kaye

[57] ABSTRACT

A method of determining the fundamental frequency or pitch period of a voice signal from a difference signal, formed with the aid of predictors, between the original voice signal and the voice signal estimated by the predictor. Only the significant characteristics of the difference signal are then auto-correlated and the maxima of the correlation coefficients determine the fundamental frequency or pitch period.

7 Claims, 7 Drawing Figures

FIG. 1
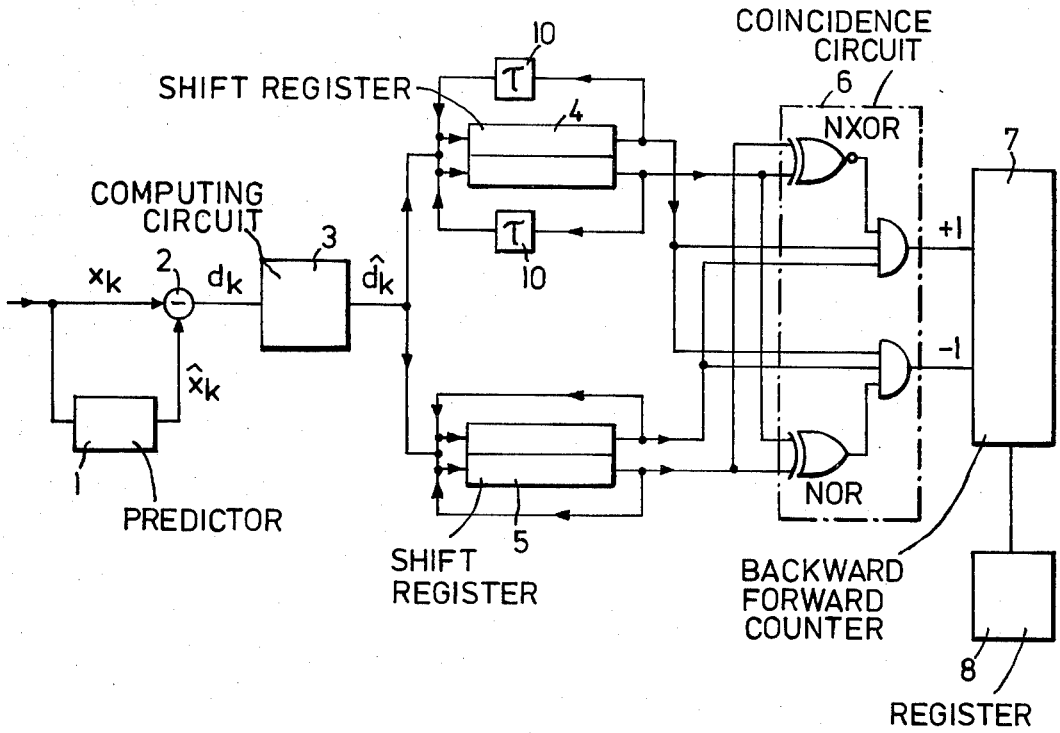
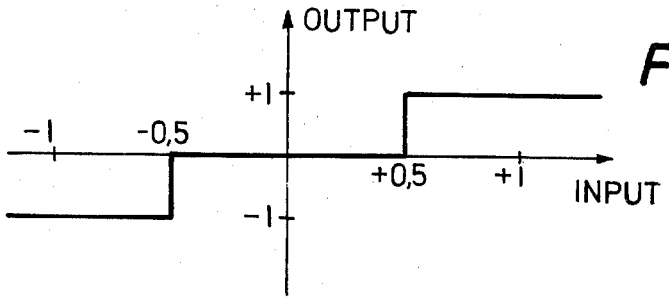
FIG. 3a
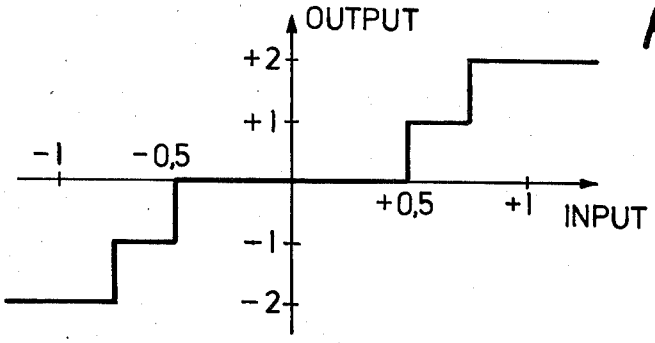
FIG. 3b

METHOD FOR DETERMINING THE FUNDAMENTAL FREQUENCY OF A VOICE SIGNAL

BACKGROUND OF THE INVENTION

The present invention relates to a method for determining the fundamental frequency or pitch period of a voice signal. More particularly, the present invention relates to a method for determining the fundamental frequency or pitch period of a voice signal utilizing the difference signal, that is generated with the aid of predictors, between the original voice signal and the estimated voice signal produced by the predictor.

Methods are already known which analyze the fundamental vocal chord frequency by means of auto-correlation of the original voice signal. These processes, however, can be strongly interfered with by the influence of formants, so that with low first formants a useful analysis is not possible when using maximum formations in the auto-correlation function. In the same way it is also not possible to produce a pure polarity correlation on the original voice signal.

The known solutions for analyzing voice frequencies from the difference signal of a linear predictive coding (LPC) Vocoder, have, until now, used exclusively the simple maximum-search methods. Such processes, however, work efficiently only with very favorable difference signals. Correlation analyses of the difference signal with full computational accuracy do indeed work effectively from a technical point of view but they necessitate very extensive technical expenditures.

Thus, methods for determining the pitch or fundamental frequency of a voice signal are disclosed, for example, by Man Mohan Sondhi, "New Methods of Pitch Extraction," *IEEE Transactions on Audio and Electroacoustics* Vol. Au-16, No. 2, June 1968, pages 262–266 and by J. D. Markel, "The SIFT Algorithm for Fundamental Frequency Estimation", *IEEE Transactions on Audio and Electroacoustics,* Vol. Au-20, No. 5, December 1972, pages 367–377. Both of these articles describe methods which determine the average fundamental frequency or pitch period but need extensive technical expenditures.

SUMMARY OF THE INVENTION

It is therefore the object of the present invention to provide a method that will identify the pitch period with high reliability and to do this with minimum technical resources.

The above object is achieved in that the original voice signal is fed to a predictor to form an estimated voice signal, a difference signal is formed by subtracting the estimated voice signal from the original signal, the difference signal is then autocorrelated only as to its significant characteristics, and the maxima of the correlation coefficients are determined as a measure of the pitch period or fundamental frequency.

According to a feature of the invention the difference signal is autocorrelated as to whether or not its value exceeds or does not exceed predetermined positive and negative threshold values.

BRIEF DESCRIPTION OF THE DRAWINGS

FIG. 1 is a block circuit diagram of a system for carrying out one embodiment of the method according to the invention.

FIG. 3*a* shows the characteristic of a quantizer included in computing circuit 3 of FIG. 1 for 2-bit quantization.

FIG. 3*b* shows a similar characteristic for a quantizer with more than 2-bit, in this example 3-bit, coding.

DETAILED DESCRIPTION OF THE PREFERRED EMBODIMENTS

Figure 2A:
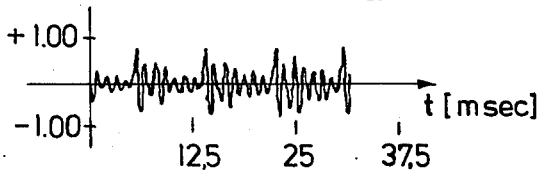
FIG. 2*a* shows the voice signal for the spoken sound (a).

As shown in FIG. 1, the voice or speech signal $x_k$ whose fundamental frequency or pitch period is to be determined by the method according to the invention is fed to the input of a predictor 1 of the type used in linear predictive coding (LPC) vocoders. In such linear predictive coding (LPC) Vocoders, the predictor 1 provides an estimate of the likely subsequent signal pattern of a voice signal on the basis of its previous values. The estimated voice signal $\hat{x}_k$ produced by the predictor 1 is fed to a difference computing network 2 wherein it is subtacted from the actual or original voice signal $x_k$. The resulting difference signal $d_k$ displays strong pulse-shaped periodicities during voiced segments. A predictor such as indicated above is described in the article by B. S. Atal and S. L. Hanaver, "Speech analysis and sythesis by linear prediction of the speech wave", J. Acoust. Soc. Amer., vol. 50, no 2, part 2, 1971.

The difference signal $d_k$ is fed to a computing circuit 3 where it is reduced to its essential or significant characteristics. Among these essential characteristics are the sign or polarity of the difference signal and information on whether the value of the differential signal exceeds a given threshold value. This threshold value is a fixed fraction of the maximum difference signal value in the signal segment that is to be correlated.

These characteristics, i.e., the sign of the difference signal and whether or not it exceeds a given threshold value, can be depicted by means of two binary bits. A third bit can be used to provide information to what extent the threshold value has been exceeded or not exceeded. This procedure can be described as a controlled quantizing with 2 or 3 bits. FIG. 1 depicts an embodiment using 2-bits.

In the computing circuit 3, the sampled values of the difference signal $d_k$ are compared with the predetermined threshold value; and the results coded to provide a coded difference signal $\hat{d}_k$. According to the preferred illustrated embodiment of the invention, in the computing circuit 3 a difference signal value above a predetermined positive threshold value is coded $+1$, a difference signal value below a predetermined negative threshold value is coded $-1$, and difference signal values between the positive and negative threshold values are coded 0. For arrangements suitable for the circuit 3 see Lawrence R. Rabiner, "In the use of autocorrelation analysis for pitch detection", IEEE Transaction on Acoustics Speech and Signal Processing, Vol ASSP-25 No. 1, pp. 24–33, February 1977, and J. J. Dubnowski, R. W. Schafer, and L. R. Rabiner, "Real-time digital hardware pitch detector", IEEE Trans. Acoust., Speech and Signal Processing, Vol ASSP-24, pp. 2–8, February 1976.

The coded difference signal $\hat{d}_k$ is fed to the input of each of a pair of 2 parallel bit shift registers 4 and 5. Each of the shift registers 4 and 5 is provided with feedback paths so that the entered data, i.e., the coded difference signal $\hat{d}_k$, can be continuously circulated. One of the shift registers 4 and 5, the shift register 4 in the illustrated embodiment, is provided with time delay elements 10 in its feedback paths so that at the output of the shift registers 4 and 5, which both circulate with the same cycle speed, there are obtained the signal values $\hat{d}_k$ and $\hat{d}_{k+i}$ which are required for purposes of autocorrelation in accordance with the formula:

$$\rho(i) = \sum_{k=1}^{n} \hat{d}_k \cdot \hat{d}_{k+i}$$

The time delay in the feedback loops of the register 4 has the effect that in the next cycle of the registers the characteristics $\hat{d}_k$ and $\hat{d}_{k+i}$ appear to be shifted with respect to each other by one scanning value, and consequently the Index i of the correlation coefficient $\rho_i$ has been increased by 1.

With a scanning frequency of 8kHz for the voice signal, or for the computed difference signal derived therefrom, the shift registers 4 and 5 may, for example, each hold 256 words having 2 or 3 bits each. Thus, at least three periods of the fundamental frequency are in the shift registers 4 and 5 and allow for sufficient correlation.

The signals $\hat{d}_k$ and $\hat{d}_{k+i}$ appearing in sequence at the outputs of the shift registers 4 and 5 are fed to a coincidence circuit 6 wherein the two signals are logically combined to determine whether the characteristics are negatively or positively correlated. These correlations, which result in either a $+1$ output or a $-1$ output, are then fed to the inputs of a forward-backward counter 7 where they are added.

After traversing, the result of the count in counter 7 is stored in a register 8 and after all possible human voice correlation values $\rho_1$ have been determined, the maximum of the correlation values will be determined. The index of the maximum is that value which identifies the number of scanning periods for the fundamental frequency or pitch period.

In a 3 bit design the coincidence circuit 6 and the counter 7 are replaced by an accumulator module (adder and register). In that case, one can dispense with a consideration of the negative correlation.

Figure 2B:
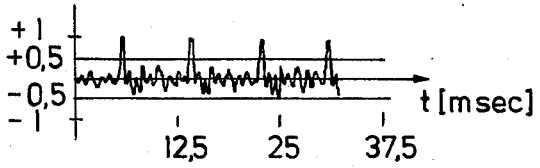
FIG. 2*b* shows the inverse filtered signal for this sound (a).
Figure 2C:
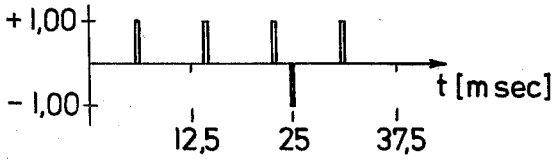
FIG. 2*c* shows the coded difference signal $\hat{d}_k$ for this sound (a).
Figure 2D:
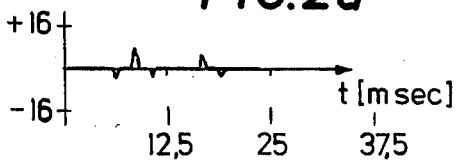
FIG. 2*d* shows the autocorrelation function of the coded difference signal for this sound (a).

FIG. 2 shows several stages of signal processing. FIG. 2*a* is the input voice signal consisting of some pitch periods of the spoken sound (a). By linear prediction a difference signal is made which is shown in FIG. 2*b*, including the thresholds for center clipping. By eliminating the signal parts below the thresholds the 1-bit signal in FIG. 2*c* is produced which consists only of the significant parts of the pitch period. By autocorrelation of this signal we get the autocorrelation function in FIG. 2*d*, which will be stored in register 8 of FIG. 1. The threshold in FIG. 2*b* is half as high the peak value of the difference signal.

This threshold must be adaptively controlled. FIG. 3*a* shows the quantization characteristic, implemented in computing circuit 3, which makes the signal in FIG. 2*c* from the signal in FIG. 2*b*.

In some cases it could give better results to quantize the values of the difference signal above the threshold with more than 1 bit. In these cases a quantization characteristic like that in FIG. 3*b* is necessary. In consequence of these mentioned threshold conditions the difference signal at any rate has to be normalized to the peak value 1.

Another but very similar way to relate the clipping threshold to the signal could be done by adaptively computing the threshold in relation to the peak value of the difference signal, preferably as a predetermined fraction of this peak value.

The advantages of the present invention, i.e., the application of polarity correlation to the difference signal of the LPC-Vocoder, combines the advantages of the autocorrelation analysis with the advantages stemming from simple technical design. This is possible as the simplified correlation represents only a minimal reduction in performance while, at the same time, allowing for an enormous simplification of the process. This simplification is so extreme that it can be realized even with highly integratable MOS circuits.

It will be understood that that the above description of the present invention is susceptible to various modifications, changes and adaptations, and the same are intended to be comprehended within the meaning and range of equivalents of the appended claims.

What is claimed is:

1. A method of determining the fundamental frequency of a voice signal comprising:

feeding the original voice signal to a predictor to form an estimated voice signal; subtracting said estimated voice signal from said original voice signal to form a difference signal; auto correlating only the significant characteristic of said difference signal; and determining the maxima of the correlation coefficients as a measure of the fundamental frequency.

2. The method as defined in claim 1 further comprising coding said difference signal as to said significant characteristics prior to said step of auto correlating.

3. A method as defined in claim 2 wherein said step of coding includes sampling the difference signal and determining whether the sampled value exceeds a predetermined positive threshold value, is below a predetermined negative threshold value, or is between said threshold values.

4. A method as defined in claim 3 wherein said step of coding further includes providing a $+1$ coded output signal when the value of said difference signal is above said positive threshold value, a $-1$ output signal when the value of said difference signal is below said negative threshold value, and a 0 coded output signal when the value of said difference signal is between said threshold values.

5. A method as defined in claim 4 wherein said step of coding further includes coding the amounts by which the values of said difference signal either exceed or fail to reach said given threshold values with more than 1 bit.

6. A method as defined in claim 5 further comprising controlling the magnitude of said threshold values in dependance on the magnitude of said difference signal.

7. A method as defined in claim 3 wherein said threshold values are a predetermined fraction of the maximum amplitude of said difference signal.

* * * * *